US005961753A

United States Patent [19]

Crombie, III

[11] Patent Number: 5,961,753

[45] Date of Patent: Oct. 5, 1999

[54] ENHANCEMENT OF MECHANICAL PROPERTIES FOR SELECTIVE PLATINUM GROUP METAL ALLOY SYSTEMS BY AGE HARDENING

[75] Inventor: Edwin Alfred Crombie, III, West Chester, Pa.

[73] Assignee: Johnson Matthey Inc., Wayne, Pa.

[21] Appl. No.: 09/015,005

[22] Filed: Jan. 28, 1998

[51] Int. Cl.[6] ..... C22C 5/04

[52] U.S. Cl. ..... 148/678

[58] Field of Search ..... 148/678, 430; 420/400

[56] References Cited

U.S. PATENT DOCUMENTS

| | | | |
|---|---|---|---|
| 5,084,108 | 1/1992 | Kretchmer | 148/3 |
| 5,484,569 | 1/1996 | Klein et al. | 420/503 |

OTHER PUBLICATIONS

Yasuda, K., "Age–Hardening and Related Phase Transformations in Dental Gold Alloys", Gold Bull., vol. 20 (4), pp. 90–103 (1987).

Smith, W.F., "Recovery and Recrystallization of Plastically Deformed Metals", Principles of Material Science and Engineering, pp. 273, 275–277 (1986).

R.F. Vines Research Laboratory, "The Platinum Metals and Their Alloys", The International Nickel Company, Inc. New York, NY, p. 72, 136 (1941).

Massalski, T.B. "Binary Alloy Phase Diagrams", vol. 3(2), pp. 2343–2344 (1990).

*Primary Examiner*—Deborah Yee

*Attorney, Agent, or Firm*—Ratner & Prestia

[57] ABSTRACT

A method for increasing the toughness of a platinum-based binary alloy system through heat treatment. An additional embodiment concerns a method whereby the material is first annealed and then heated appropriately to achieve an increase in tensile strength without a decrease in ductility. By selecting a binary composition within its defined miscibility gap and heat treating it for a prolonged period of time at a temperature that is within the miscibility gap but below the recrystallization temperature, an increased tensile strength and ductility is obtained with respect to the initial conditions of the composition. An exemplary embodiment concerns platinum-iridium alloys, particularly those compositions where iridium is present at either 20% or 25%. One particular application of this method concerns the manufacture of corkscrew fixation devices used in the biomedical industry.

28 Claims, 1 Drawing Sheet

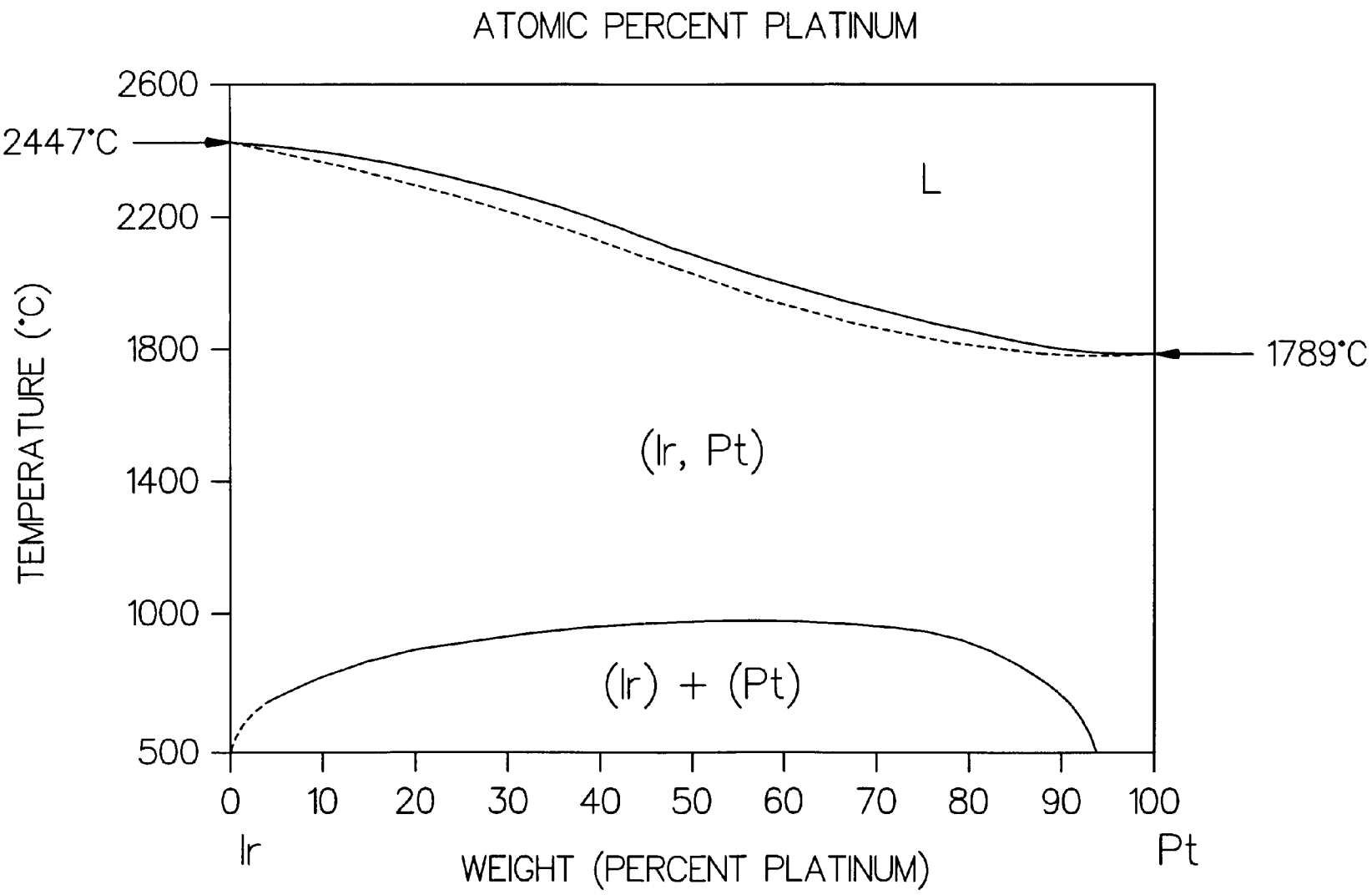
ATOMIC PERCENT PLATINUM
1789°C
L
(Ir, Pt)
(Ir) + (Pt)
2447°C
2600
2200
1800
1400
1000
500
TEMPERATURE (°C)
0
10
20
30
40
50
60
70
80
90
100
Ir
Pt
WEIGHT (PERCENT PLATINUM)

ENHANCEMENT OF MECHANICAL PROPERTIES FOR SELECTIVE PLATINUM GROUP METAL ALLOY SYSTEMS BY AGE HARDENING

FIELD OF INVENTION

This invention relates generally to binary alloy systems. More specifically, this invention relates to processes which affect the tensile strength and ductility of platinum-based binary alloy systems.

BACKGROUND OF INVENTION

It is well known that the microstructural and related mechanical property changes for binary alloy systems can be influenced by temperature treatment. This is especially true in cases in which the composition sought to be affected displays a miscibility gap over some range of composition distribution. For purposes of this invention, the miscibility gap of a given binary alloy is that region where, for a given temperature and composition, the two components are not fully miscible with each other. Moreover, in the miscibility gap, each component exists in a stable form. That is to say, a two-phase field exists.

It is well documented in the literature that several platinum-based binary alloy systems have confirmed miscibility gaps. Some examples of these binary alloy systems include: Au—Pt, Pd—Pt, Pt—Ir, and Pt—Rh. It is also well documented in the literature that the mechanical properties for these alloy systems are dependent upon the method by which the alloys are worked. For example, cold-work, strain hardening results in increased tensile strength but reduced ductility, and short term heat treatment results in increased ductility but reduced tensile strength.

An example of a process combining several process steps is disclosed in U.S. Pat. No. 5,084,108 to Kretchmer. This patent discloses a method for forming compression spring gemstone mountings wherein a heat-treatable metal is annealed and heat treated to increase the yield strength. The method disclosed, however, results in an increase to Vickers hardness (specified as an increase in both strength and elastic behavior) and a corresponding reduction in ductility (plastic behavior).

SUMMARY OF INVENTION

The present invention provides a method of heat treatment for a platinum-based binary alloy system (e.g., a platinum-iridium (Pt—Ir) alloy system) that can be utilized to enhance strength and ductility simultaneously. The method comprises aging a platinum-based binary alloy system at a temperature and for a duration sufficient to cause an increase in both tensile strength and ducitlity (toughness). In an exemplary embodiment, a temperature is selected which is within the miscibility gap but below the recrystallization temperature of the system. Moreover, processing times and temperatures may be selected to achieve increases in both ductility and tensile strength (or an increase in one of these characteristics without a significant decrease in the other).

It is to be understood that both the foregoing general description and the following detailed description are exemplary, but are not restrictive, of the invention.

BRIEF DESCRIPTION OF THE DRAWING

FIG. 1 is an equilibrium phase diagram for a platinum-iridium (Pt—Ir) alloy system.

DETAILED DESCRIPTION OF THE INVENTION

This invention provides a method for prolonged heat treatment of a platinum-based binary alloy system (e.g., a platinum-iridium (Pt—Ir) alloy system) that can be utilized to enhance strength and ductility simultaneously (i.e. increase toughness). The method disclosed implies that a similar heat treatment may be applied to other Pt binary alloy systems having a miscibility gap. With knowledge of the temperature and compositional range of the miscibility gap and the recrystallization behavior of the alloy, processing times and temperatures may be selected accordingly.

According to the present invention, processing times and temperatures are selected with consideration of the following factors:

Time dependency of diffusion related processes;

The compositional range of the miscibility gap;

Experimental determination of the minimum temperature at which recrystallization occurs for the composition of interest; and Experimental determination of the temperature at which ordering or precipitation hardening occurs.

The recrystallization temperature is the minimum temperature at which complete recrystallization will occur in the alloy within a specified time. That is to say, at a temperature below the recrystallization temperature, complete recrystallization will not occur in the given time upon which the recrystallization temperature was determined. In addition to being a function of the heating time, the recrystallization temperature is a finction of the particular composition of the alloy and the amount of stored strain energy due to cold-working the alloy. Based on these three parameters, one skilled in the art could easily determine the recrystallization temperature. The temperature selected for the aging process according to the present invention will be below the recrystallization temperature, but within the miscibility gap of the alloy of interest.

As discussed above, the length of time chosen for the aging process is dependent upon the diffusion related processes occurring within the alloy. For a given binary alloy when one knows the temperature at which the aging process will occur, and the interdiffusional rate of the two constituents of the alloy at that temperature can easily be determined. From the diffusion rates, the time can be calculated which will likely achieve adequate diffusion of atoms such that the desired increase in toughness of the material is accomplished.

Of course, preferred aging process times can be readily determined empirically by varying the aging process times while keeping all other parameters constant, and measuring the strength and ductility of the resulting alloy. As shown in the Examples below, there appears to be an optimum range of times where maximum improvement in toughness is achieved; in particular, as time is increased above this optimum range, a decrease in strength can result.

Moreover, the method used to achieve the results according to the present invention begins with the selection of a binary metal alloy composition with a defined miscibility gap and heat treating that system for a prolonged period of time at a temperature that is both within the miscibility gap but below the recrystallization temperature. This results in an increase in both strength and ductility with respect to the initial conditions of the material. An alternative embodiment of the method achieves an increase in tensile strength without a significant decrease in ductility.

The Pt/Ir alloy having 20% iridium by weight (Pt/20% Ir) and the Pt/Ir alloy having 25% iridium by weight (Pt/25% Ir) are presented below as examples of the effectiveness of the present invention.

EXAMPLES

Per the equilibrium phase diagram for the Pt—Ir alloy system shown in FIG. 1, (Binary Alloy Phase Diagrams, Massalaski, and ASM International), there is clearly a well defined miscibility gap ranging from 5–95 weight % Pt content. Furthermore, the structures of this region are predicted to be stable at temperatures up to 980° C. (1796° F.) for the 50% by weight Pt composition. In particular, stability is predicted for the Pt/20% Ir up to 920° C. (1688° F.) and Pt/25% Ir up to 960° C. (1760° F.).

Furthermore, the recrystallization temperatures for Pt/20% Ir and Pt/25% Ir that have been cold work strengthened by greater than 90% reduction is greater than 900° C. (1652° F.) for heating times below 1 hour.

Therefore, by selecting aging temperatures below 900° C. (1652° F.) and aging for prolonged periods of time, this invention provides that both strength and ductility can be enhanced simultaneously as compared to the original tensile strength conditions of the as-drawn cold worked material.

Example 1

A sample of 80wt % Pt/20wt % Ir wire was drawn to 0.020" diameter in the full hard condition (>90% area reduction). Samples of this material were processed according to this invention at each of 1000° F., 1200° F., 1300° F., and 1400° F. for each of 1 hour, 5 hours, and 24 hours. Each of the twelve heat treated specimens was then evalutated for tensile properties including: ultimate tensile strength (UTS), which is defined as the maximum stress endured by the material prior to breaking and measured in thousands of pounds per square inch (KSI); yield strength (YS), which is defined as the stress at which the material exhibits deviation from proportional relationship between stress and strain, measured in KSI; and elongation (EL), which is defined as the relative amount by which the material increases in length before breaking, measured in percent of change.

Results of processing according to the present invention are reported in TABLE I and can be compared to the results for the wire before processing. The effect of the invention can be seen for temperatures of 1200° F. to 1400° F. for times of 1 to 5 hours, and for temperatures of 1200° F. to 1300° F. for times of 1 to 24 hours. In those cases, both UTS and EL increased. The increase in UTS is from 152 KSI in the untreated material to 154.4 KSI to 168.3 KSI in the treated samples. The increase in EL was from 3% in the untreated material to 6.7% to 11.0% in the treated samples.

TABLE 1

Pt/20% Ir .020" Diameter (Full Hard)
Initial: UTS 152 KSI YS 149 KSI EL 2.98%

| | AGING TIME | | | | | | | | |
|---|---|---|---|---|---|---|---|---|---|
| | 1 Hour | | | 5 Hours | | | 24 Hours | | |
| Temp. (° F.) | UTS (KSI) | YS (KSI) | EL (%) | UTS (KSI) | YS (KSI) | EL (%) | UTS (KSI) | YS (KSI) | EL (%) |
| 1000 | 147.5 | 141.9 | 6.7 | 148.7 | 134.5 | 7.0 | 151.4 | 138.0 | 7.3 |
| 1200 | 154.4 | 141.1 | 8.2 | 161.8 | 152.9 | 8.3 | 168.3 | 153.6 | 9.8 |
| 1300 | 159.6 | 145.8 | 8.0 | 164.2 | 152.0 | 10.1 | 164.3 | 148.3 | 11.0 |
| 1400 | 159.3 | 143.1 | 6.7 | 157.6 | 147.5 | 10.6 | 151.2 | 138.8 | 11.4 |

Example 2

A sample of 75wt% Pt/25wt % Ir wire was drawn to 0.020" diameter in the full hard condition (>90% area reduction). Samples of this material were processed according to this invention at each of 1000° F., 1200° F., 1300° F., 1400° F., and 1500° F. for each of 1 hour, 5 hours, and 24 hours. Each of the fifteen heat treated specimens was evalutated for tensile properties as described in EXAMPLE 1. Results of processing are reported in TABLE II and can be compared to the results for the wire before processing. The effect of the invention can be seen for the temperature of 1300° F. for times of 5 to 24 hours and temperatures of 1200° F. to 1300° F. for 24 hours. Again, both UTS and EL increase. The increase in UTS 236.2 KSI in the untreated material to 243.7 KSI to 249 KSI in the treated samples. Increase in EL was from 3.3% in the untreated material to 6.0% to 6.1% in the treated sample.

TABLE II

Pt/25% Ir .020" Diameter (Full Hard)
Initial: UTS 236.2 KSI YS 212.2 KSI EL 3.3%

| | AGING TIME | | | | | | | | |
|---|---|---|---|---|---|---|---|---|---|
| | 1 Hour | | | 5 Hours | | | 24 Hours | | |
| Temp. (° F.) | UTS (KSI) | YS (KSI) | EL (%) | UTS (KSI) | YS (KSI) | EL (%) | UTS (KSI) | YS (KSI) | EL (%) |
| 1000 | 226.1 | 206.1 | 6.5 | 225.6 | 201.2 | 6.7 | 229.7 | 194.8 | 5.2 |
| 1200 | 229.4 | 207.5 | 6.4 | 236.0 | 203.5 | 5.9 | 246.2 | 219.7 | 6.0 |
| 1300 | 236.5 | 295.2 | 6.2 | 243.7 | 225.6 | 6.1 | 249.0 | 228.0 | 6.1 |
| 1400 | 235.7 | 213.6 | 4.9 | 232.5 | 213.0 | 5.7 | 222.1 | 205.0 | 5.7 |
| 1500 | 216.9 | 203.6 | 5.8 | 201.4 | 196.1 | 8.0 | 184.3 | 178.8 | 12.2 |

Example 3

A sample of the untreated material of EXAMPLE 1 (80wt % Pt/20wt % Ir) was fully annealed and evaluated for tensile properties as defined in Example 1. Samples of the annealed material were processed acoording to this invention at each of 1000° F., 1200° F., 1300° F., and 1400° F., for each of 1 hour, 5 hours, and 24 hours. Each of the twelve heat treated specimens was evaluated for tensile properties as defined in EXAMPLE 1. Results of processing are reported in TABLE III and can be compared to the results for the wire as annealed but before processing according to the invention. The effect of the invention can be seen for temperatures of 1000° F. to 1400° F. for times of 1 to 24 hours. TABLE III shows an increase in UTS with minimal concurrent reduction in EL. The increase in UTS is from 94.7 KSI in the untreated material to 99.5 to 115.7 KSI in the treated samples.

TABLE III

Pt/20% Ir .020" Diameter (Annealed)
Initial: UTS 94.7 KSI YS 71.8 KSI EL 26.6%

| | AGING TIME | | | | | | | | |
|---|---|---|---|---|---|---|---|---|---|
| | 1 Hour | | | 5 Hours | | | 24 Hours | | |
| Temp. (° F.) | UTS (KSI) | YS (KSI) | EL (%) | UTS (KSI) | YS (KSI) | EL (%) | UTS (KSI) | YS (KSI) | EL (%) |
| 1000 | 99.5 | 74.3 | 22.5 | 98.4 | 73.5 | 23.4 | 99.5 | 73.7 | 23.9 |
| 1200 | 102.7 | 78.5 | 21.3 | 109.1 | 83.7 | 25.0 | 115.7 | 89.8 | 22.8 |
| 1300 | 107.9 | 82.9 | 25.3 | 112.6 | 88.4 | 25.4 | 115.6 | 91.1 | 23.9 |
| 1400 | 107.7 | 84.5 | 23.4 | 108.2 | 83.2 | 25.1 | 107.8 | 83.3 | 24.4 |

Example 4

A sample of the untreated material of EXAMPLE 2 (75wt % Pt/25wt % Ir) was fully annealed and evaluated for tensile properties as defined in EXAMPLE 1. Samples of the annealed material were processed according to this invention at each of 1000° F., 1200° F., 1300° F., 1400° F., and 1500° F. for each of 1 hour, 5 hours, and 24 hours. Each of the fifteen heat treated specimens was evaluated for tensile properties as defined in EXAMPLE 1. Results of processing are reported in TABLE IV and can be compared to the results for the wire as annealed but before processing according to the invention. The effect of the invention can be seen for temperatures of 1000° F. to 1500° F. for times of 1 to 24 hours. The effect was an increased UTS with minimal concurrent reduction in EL. The increase in UTS is from 128.7 KSI in the untreated material to 132.9 KSI to 186 KSI in the treated samples.

TABLE IV

Pt/25% Ir .020" Diameter (Annealed)
Initial: UTS 128.7 KSI YS 97.6 KSI EL 25.1%

| | AGING TIME | | | | | | | | |
|---|---|---|---|---|---|---|---|---|---|
| | 1 Hour | | | 5 Hours | | | 24 Hours | | |
| Temp. (° F.) | UTS (KSI) | YS (KSI) | EL (%) | UTS (KSI) | YS (KSI) | EL (%) | UTS (KSI) | YS (KSI) | EL (%) |
| 1000 | 132.9 | 100.4 | 26.6 | 133.3 | 102.6 | 23.6 | 134.6 | 103.7 | 24.3 |
| 1200 | 137.5 | 106.7 | 24.1 | 143.3 | 114.3 | 23.5 | 152.7 | 124.2 | 21.7 |
| 1300 | 145.5 | 116.4 | 23.3 | 152.4 | 122.7 | 23.9 | 155.7 | 129.4 | 20.1 |

TABLE IV-continued

Pt/25% Ir .020" Diameter (Annealed)
Initial: UTS 128.7 KSI YS 97.6 KSI EL 25.1%

| | AGING TIME | | | | | | | | |
|---|---|---|---|---|---|---|---|---|---|
| | 1 Hour | | | 5 Hours | | | 24 Hours | | |
| Temp. (° F.) | UTS (KSI) | YS (KSI) | EL (%) | UTS (KSI) | YS (KSI) | EL (%) | UTS (KSI) | YS (KSI) | EL (%) |
| 1400 | 146.5 | 116.7 | 23.4 | 146.9 | 118.2 | 22.1 | 142.4 | 119.O | 18.4 |
| 1500 | 139.1 | 109.2 | 23.9 | 136.9 | 108.7 | 22.9 | 186.O | 107.5 | 22.5 |

Application of this invention is particularly useful where an increase of both tensile strength and ductility (resulting in an increase in material toughness) by comparison to the current as-cold worked strengthened condition is desired.

It is well known from the literature that the area under the stress-strain (Tensile Curve) represents the material property defined as toughness. Toughness is increased when strength or ductility is improved without the compromise of the other. Thus, the present invention allows an effective increase in toughness of the material treated in conjunction with the methods herein disclosed. More specifically, previous improvements in strength or ductility have been reported to occur at the compromise of one another, minimizing the net increase in toughness. Per this invention, strength and ductility increase when applied to previously cold-work strengthened material resulting in maximum increase in toughness.

When applied to previously annealed material, the aging heat treatment defined herein results in improved tensile strength while maintaining high levels of ductility.

Application of this invention is useful in enhancing performance where improved toughness is desired. One particular application concerns biomedical applications such as corkscrew fixations. When inserting corkscrew fixations into the heart muscle tissue, it may be desirable to remove and re-insert the device at a different location to improve distribution of the pulsing charge. Typical current corkscrews formed from similar alloys that have been traditionally strengthened may fail on removal and/or reinsertion. Application of this invention would reduce such failure by increasing the material toughness and thereby resistance to torsional loading. This invention could be utilized either before or after the corkscrew is formed.

In addition, utilization of this invention would be applicable to improved manufacturability of many products. When forming is required, the material can be initially rendered to a higher level of ductility prior to forming. This aspect minimizes the risk of strain cracking during forming, without compromising the strength of the material.

In conditions of severe forming, the component can be reduced to the condition of maximum ductility and minimum strength (fully annealed) then strength enhanced after forming.

The temperature range over which this phenomenon occurs varies from alloy to alloy, but will always be within the miscibility gap of the alloy in question and below the recrystallization temperature of the alloy in question. Time of heating is greater than one hour (typically at least 5 hours and preferably 5 to 24 hours). (Previous literature typically reports heat treatment for mechanical properties less than or equal to one hour).

Pt/Ir Alloy System:
Composition Range: 5–95% Ir
Aging Conditions: 1000–1500° F., 5–48 hours
Pt/Pd Alloy System:
Composition Range: 10–90% wt Pd
Aging Conditions: 900–1400° F., 5–48 hours
Pt/Rh Alloy System:
Composition Range: 10–90% wt Rh
Aging Conditions: 900–1400° F., 5–48 hours
Pt/Au Alloy System:
Composition Range: 5–85% wt Au
Aging Conditions: 800–1400° F., 5–48 hours Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

What is claimed:

1. A method for increasing the toughness of a platinum-based binary alloy system, the method comprising:

aging a platinum-based binary alloy system at a temperature in the range of 1200° F. to 1400° F. for a duration of 5–30 hours.

2. The method of claim 1 wherein said platinum-based binary alloy system comprises platinum and iridium.

3. The method of claim 1 wherein said platinum-based binary alloy system comprises a platinum and iridium alloy with iridium present at a concentration between about 15 weight % and 50 weight % with remainder platinum.

4. The method of claim 1 wherein said alloy system comprises substantially 80% platinum by weight and remainder iridium.

5. The method of claim 1 wherein said alloy system comprises substantially 75% platinum by weight and remainder iridium.

6. A method for increasing the toughness of a platinum-based binary alloy system, the method comprsing:

selecting a binary alloy system which is characterized by a defined miscibility gap;

heating said alloy to a temperature which is within the miscibility gap but below the recrystallization temperature; and maintaining said temperature for a duration sufficient to achieve a defined tensile strength and ductility.

7. The method of claim 6 wherein said platinum-based binary alloy system comprises platinum and iridium.

8. The method of claim 6 wherein said platinum-based binary alloy system comprises a platinum and iridium alloy with iridium present at a concentration between about 15 weight % and about 50 weight % with remainder platinum.

9. The method of claim 6 wherein said alloy system comprises substantially 80% platinum by weight and remainder iridium.

10. The method of claim 6 wherein said alloy system comprises substantially 75% platinum by weight and remainder iridium.

11. The method of claim 6 wherein said alloy is aged for a period of time ranging from about 5 hours to about 24 hours at a temperature between about 1200° F. and 1300° F.

12. The method of claim 8 wherein said alloy is aged for a period of time ranging from about 5 hours to about 24 hours at a temperature between about 1200° F. and 1300° F.

13. A method for manufacturing a platinum-based cork screw fixation device, the method comprising:

selecting a binary alloy system material whose components are characterized by a defined miscibility gap;

heating said alloy to a temperature which is within the miscibility gap but below the recrystallization temperature;

maintaining said temperature for a duration sufficient to achieve a defined tensile strength and ducitility; and forming a cork screw fixation device from said material after tensile stength and ductility have been increased.

14. A method for manufacturing a platinum-based cork screw fixation device, the method comprising:

selecting a binary alloy system material whose components are characterized by a defined miscibility gap;

forming a cork screw fixation device from said material;

heating said alloy to a temperature which is within the miscibility gap but below the recrystallization temperature; and maintaining said temperature for a duration sufficient to achieve a defined tensile strength and ducitility.

15. A method for increasing the tensile strength of a platinum-based binary alloy without decreasing its ductility, the method comprising:

annealing a platinum-based binary alloy system;

after annealing, aging said annealed platinum-based binary alloy system at a temperature in the range of 1200° F. to 1400° F. for a duration of 5–30 hours.

16. The method of claim 15 wherein said platinum-based binary alloy system comprises platinum and iridium.

17. The method of claim 15 wherein said platinum-based binary alloy system comprises a platinum and iridium alloy with iridium present at a concentration between about 15 weight % and 50 weight % with remainder platinum.

18. The method of claim 15 wherein said alloy system comprises substantially 80% platinum by weight and remainder iridium.

19. The method of claim 15 wherein said alloy system comprises substantially 75% platinum by weight and remainder iridium.

20. A method for increasing the tensile strength of a platinum-based binary alloy system without decreasing its ductility, the method comprising:

annealing a binary alloy system, said system characterized by a defined miscibility gap;

after annealing, heating said alloy to a temperature which is within the miscibility gap but below the recrystallization temperature; and maintaining said temperature for a duration sufficient to achieve a defined tensile strength.

21. The method of claim 20 wherein said platinum-based binary alloy system comprises platinum and iridium.

22. The method of claim 20 wherein said platinum-based binary alloy system comprises a platinum and iridium alloy with iridium present at a concentration between about 15 weight % and about 50 weight % with remainder platinum.

23. The method of claim 20. wherein said alloy system comprises substantially 80% platinum by weight and remainder iridium.

24. The method of claim 20 wherein said alloy system comprises substantially 75% platinum by weight and remainder iridium.

25. The method of claim 15 wherein said alloy is aged for a period of time ranging from about 5 hours to about 24 hours at a temperature between about 1000° F. and 1500° F.

26. The method of claim 20 wherein said alloy is aged for a period of time ranging from about 5 hours to about 24 hours at a temperature between about 1000° F. and 1500° F.

27. The method of claim 1 wherein said platinum-based binary alloy system is comprised of platinum and 20% iridium, and wherein said aging step is performed at a temperature of 1200° F. for 20–25 hours.

28. The method of claim 1 wherein said platinum-based binary alloy system is comprised of platinum and 25% iridium, and wherein said aging step is performed at a temperature of 1300° F. for 20–25 hours.

* * * * *